US008449693B2

(12) United States Patent
Sheffield

(10) Patent No.: US 8,449,693 B2
(45) Date of Patent: May 28, 2013

(54) PAINT ROLLER CLEANING AND DRYING APPARATUS

(76) Inventor: George C. Sheffield, Waverly, VA (US)

( * ) Notice: Subject to any disclaimer, the term of this patent is extended or adjusted under 35 U.S.C. 154(b) by 551 days.

(21) Appl. No.: 12/798,440

(22) Filed: Apr. 5, 2010

(65) Prior Publication Data

US 2011/0041880 A1 Feb. 24, 2011

Related U.S. Application Data

(60) Provisional application No. 61/274,592, filed on Aug. 20, 2009.

(51) Int. Cl.
*B08B 3/00* (2006.01)

(52) U.S. Cl.
USPC ..... 134/115 R; 134/135

(58) Field of Classification Search
USPC ..... 134/115 R
See application file for complete search history.

(56) References Cited

U.S. PATENT DOCUMENTS 3,873,364 A * 3/1975 Smith ..... 134/138
4,172,373 A * 10/1979 Lary ..... 68/213
4,380,478 A * 4/1983 Cooney ..... 134/38
4,402,333 A * 9/1983 Frizzell et al. ..... 134/138
4,448,209 A * 5/1984 Lindsay ..... 134/141
4,508,465 A * 4/1985 Orton ..... 15/1
4,672,987 A * 6/1987 Brandt ..... 134/138
4,708,152 A * 11/1987 Hibberd ..... 134/138
4,733,679 A * 3/1988 Dolcater ..... 134/138
4,832,066 A * 5/1989 Shipman ..... 134/137
5,050,626 A * 9/1991 Brockage et al. ..... 134/138
5,095,928 A * 3/1992 Phipps ..... 134/138
5,111,834 A * 5/1992 O'Brien ..... 134/137
5,322,081 A * 6/1994 Isaac ..... 134/182
5,330,065 A * 7/1994 Bradley ..... 211/163
5,337,769 A * 8/1994 Howe ..... 134/138
5,363,869 A * 11/1994 McDowell ..... 134/104.2
5,402,808 A * 4/1995 Wallis et al. ..... 134/104.2
5,413,133 A * 5/1995 Russell ..... 134/138
5,487,399 A * 1/1996 Hannah ..... 134/138
5,505,220 A * 4/1996 Gorecki ..... 134/138
5,544,668 A * 8/1996 Dollar ..... 134/104.2
5,839,459 A * 11/1998 Bisby ..... 134/138
5,932,028 A * 8/1999 Carrie et al. ..... 134/32
5,935,342 A * 8/1999 Boyd ..... 134/33

(Continued)

OTHER PUBLICATIONS

Leblond, May 26, 2005, Rotative Cleaning and Sanitizing Device, May 26, 2005, http://www.invention.net/leblond.htm.*

*Primary Examiner* — Michael Barr
*Assistant Examiner* — Thomas Bucci
(74) *Attorney, Agent, or Firm* — William G. Sykes

(57) ABSTRACT

A paint roller cleaning and drying assembly having a hollow cylindrical body having open top and bottom ends and a hingedly attached cover selectively movable between be closed and open position. A nozzle plenum disposed on an inside body surface substantially parallel to the major axis thereof carries a row of spray nozzles. The nozzle plenum may optionally have an interior cross sectional area that varies along its length to equalize fluid pressure delivered to nozzles disposed along the length thereof. A fluid inlet tube with a hose fitting and valve passes through the wall of the body delivering fluid to the nozzle plenum. Legs support the body in an upright orientation. Notches in the bottom of the legs support the apparatus on the lip of a bucket or pail. A roller support bar has one or more roller cover supports depending downwardly from a lower surface.

18 Claims, 7 Drawing Sheets

U.S. PATENT DOCUMENTS

| | | | | |
|---|---|---|---|---|
| 6,408,862 | B1 * | 6/2002 | van Rooyen | 134/138 |
| 6,450,185 | B1 * | 9/2002 | Sallinen | 134/138 |
| 7,325,557 | B2 * | 2/2008 | Wallace, III | 134/38 |
| 7,640,941 | B2 * | 1/2010 | Watters et al. | 134/138 |
| 2007/0169798 | A1 * | 7/2007 | Barr et al. | 134/198 |
| 2008/0035185 | A1 * | 2/2008 | Baratta | 134/137 |
| 2008/0072932 | A1 * | 3/2008 | Nicholas | 134/34 |
| 2008/0078429 | A1 * | 4/2008 | Hoffmann | 134/178 |
| 2008/0105284 | A1 * | 5/2008 | Bates | 134/198 |
| 2009/0000646 | A1 * | 1/2009 | Durant et al. | 134/22.11 |
| 2009/0025758 | A1 * | 1/2009 | Watson et al. | 134/70 |
| 2010/0300500 | A1 * | 12/2010 | McPhee, III | 134/198 |
| 2011/0005952 | A1 * | 1/2011 | Fenn | 206/361 |
| 2011/0017242 | A1 * | 1/2011 | Fiorino et al. | 134/34 |
| 2012/0037194 | A1 * | 2/2012 | Suydam | 134/198 |

* cited by examiner

PAINT ROLLER CLEANING AND DRYING APPARATUS

RELATED APPLICATIONS

This application claims priority in accordance with 35 U.S.C §119(e) to U.S. Provisional Patent Application Ser. No. 61/274,592 filed Aug. 20, 2009 which is included herein in its entirety by reference.

BACKGROUND OF THE INVENTION

1. Field of the Invention

The invention pertains to a cleaning apparatus for painter's tools and, more particularly, to a paint roller cleaner apparatus.

One of the useful tools available to the painter today is the paint roller. It enables both the professional and the amateur to cover an area much more quickly and with less effort than a paint brush, the old standard, particularly of professional house painters. One problem related to the paint roller is the difficulty in cleaning it when the job is done. The roller has a much larger surface area than a brush and with the usual fairly dense nap is difficult to clean by hand.

Another problem for painters is that of changing colors during a job. Because of the time and effort required to clean a roller using techniques of the prior art, many painters opt to use a clean roller for each subsequent color. This results in multiple rollers requiring cleaning at the completion of a job. Human nature being what it is, there is always the temptation to discard the used rollers after the job. This is costly because good, professional quality roller covers are expensive. In addition dirty rollers entering the solid waste stream may provide an environmental hazard.

2. Discussion of the Related Art

Previous efforts to provides apparatus and methods for cleaning paint rollers may be found in the prior art. For example, U.S. Pat. No. 3,873,364 for PAINT ROLLER SLEEVE WASHER, issued Mar. 25, 1975 to Joseph L. Smith discloses a paint roller horizontally mounted on a spindle in a downwardly opening hollow housing.

U.S. Pat. No. 4,402,333 for PAINT ROLLER CLEANING DEVICE, issued Sep. 6, 1983 to Leon E. Frizzell, discloses a paint roller cleaner using a water jet to simultaneously wash and spin a paint roller.

U.S. Pat. No. 4,508,465 for APPARATUS FOR CLEANING PAINT ROLLERS, issued Apr. 2, 1985 to J. Berkley Orton discloses a garden hose attachment with a combination soaker and scraper to clean a roller.

U.S. Pat. No. 4,708,152 for PAINT ROLLER CLEANER APPARATUS, issued Nov. 24, 1987 TO Carl G. Hibberd teaches a paint roller cleaner having a plurality of fan jets directed at the roller being cleaned.

U.S. Pat. No. 5,095,928 for PAINT ROLLER CLEANING DEVICE, issued Mar. 17, 1992 to William A. Phipps also discloses a paint roller cleaner with multiple jets impinging on a roller.

U.S. Pat. No. 5,337,769 for PAINT ROLLER COVER CLEANING DEVICE, issued Aug. 16, 1994 to Michael E. Howe discloses a drum device with a garden hose attachment spraying the roller.

U.S. Pat. No. 5,413,133 for PAINT ROLLER CLEANING DEVICE, issued May 9, 1995 to Frank A. Russell teaches a roller cleaner with a multiple orifices spraying the roller.

U.S. Pat. No. 5,487,399 for PAINT ROLLER CLEANER, issued Jan. 30, 1996 to Dale A. Hannah discloses a paint roller cleaner in which the roller is separated from the frame and mounted on a freely rotatable support frame with an internal spray tube at the center and an external spray tube on the outside of the housing with multiple spray nozzles.

U.S. Pat. No. 5,505,220 for DUAL TANGENTIAL SPRAY PAINT ROLLER CLEANER, issued Apr. 9, 1996 to Joseph D. Gorecki discloses a paint roller cleaner having a tubular casing with four legs and two spray bars and an enclosed bottom surface.

U.S. Pat. No. 5,839,459 for PAINT ROLLER CLEANING APPARATUS, issued Nov. 24, 1998 to William G. Bisby teaches a paint roller cleaning apparatus having a hollow pipe with notches at a lower end. A tubular spray arm having a plurality of spaced apart apertures is rotatably mounted within the tube. A clip on the exterior of the tube grips the support rod of a paint roller.

U.S. Pat. No. 5,935,342 for PAINT ROLLER CLEANER, issued Aug. 10, 1999 to Phillip B. Boyd teaches a paint roller cleaner having a tubular body within which a paint roller to be cleaned is held so that fluid is sprayed thereupon by a traversing nozzle.

None of the patents and published patent applications, taken singly, or in any combination are seen to teach or suggest the novel paint roller cleaning and drying apparatus of the present invention.

SUMMARY OF THE INVENTION

In accordance with the present invention there is provided a paint roller cleaning and drying assembly that consists of a hollow cylindrical body having both an open top and bottom. The top may selectively be closed by a cover that is hingedly attached to the body and rests on a flange placed at the upper edge of the cylindrical body.

A nozzle plenum attached to the inside surface of the cylindrical body substantially parallel to the major axis of the body supports a row of spray nozzles that are aimed into an interior region of the hollow cylindrical body. The nozzle plenum may optionally have an interior cross sectional area that varies along its length to equalize fluid pressure delivered to nozzles disposed along the length thereof. A fluid inlet tube passes through the wall of the hollow cylindrical body allowing delivery of fluid to the nozzle plenum. The exterior end of the fluid tube may have a hose fitting allowing ready attachment of the fluid tube to a source of water or other fluid. A valve may be inserted between the hose fitting and the outside wall of the hollow cylindrical body.

Legs near the bottom of the body hold the body in an upright, spaced apart position relative to a horizontal environmental surface (e.g., a sink bottom, pavement, etc.) upon which the paint roller cleaning and drying apparatus may be placed and operated. Notches formed along the bottom edge of the legs allow the paint roller cleaning and drying apparatus to be supported on the lip or rim of a bucket or pail. Multiple pairs of notches may be provided to allow attachment of the paint roller cleaning and drying apparatus to different diameter buckets or pails.

A roller support bar supported on the top flange has at least one roller cover support depending downwardly from a lower surface thereof. The roller cover is free to rotate so a roller cover being cleaned may spin. More than one roller cover support may be provided. Roller cover supports of different diameters allow cleaning roller covers of different sizes.

A latch mechanism and/or carrying handle may be provided on the cover or lid.

It is, therefore, an object of the invention to provide a paint roller cleaning apparatus that may be used to clean rollers used various coatings and liquids typically applied by a paint roller.

It is another object of the invention to provide a paint roller cleaning apparatus that will accommodate varied styles and sizes of paint rollers.

It is an additional object of the invention to provide a paint roller cleaning apparatus that may clean and dry paint rollers quickly and economically.

It is a further object of the invention to provide a paint roller cleaning apparatus that is particularly suitable for use with paint rollers used with water soluble or dispersed coatings.

It is a still further object of the invention to provide a paint roller cleaning apparatus that minimizes the mess typically associated with cleaning paint rollers.

It is yet another object of the invention to provide a paint roller cleaning apparatus that is inexpensive and easy to clean and maintain.

BRIEF DESCRIPTION OF THE DRAWINGS

Various objects, features, and attendant advantages of the present invention will become more fully appreciated as the same become better understood when considered in conjunction with the accompanying drawings, in which like reference characters designate the same or similar parts throughout the several views, and wherein.

DETAILED DESCRIPTION OF THE PREFERRED EMBODIMENT

The present invention provides a paint roller cleaning and drying apparatus.

Figure 1:
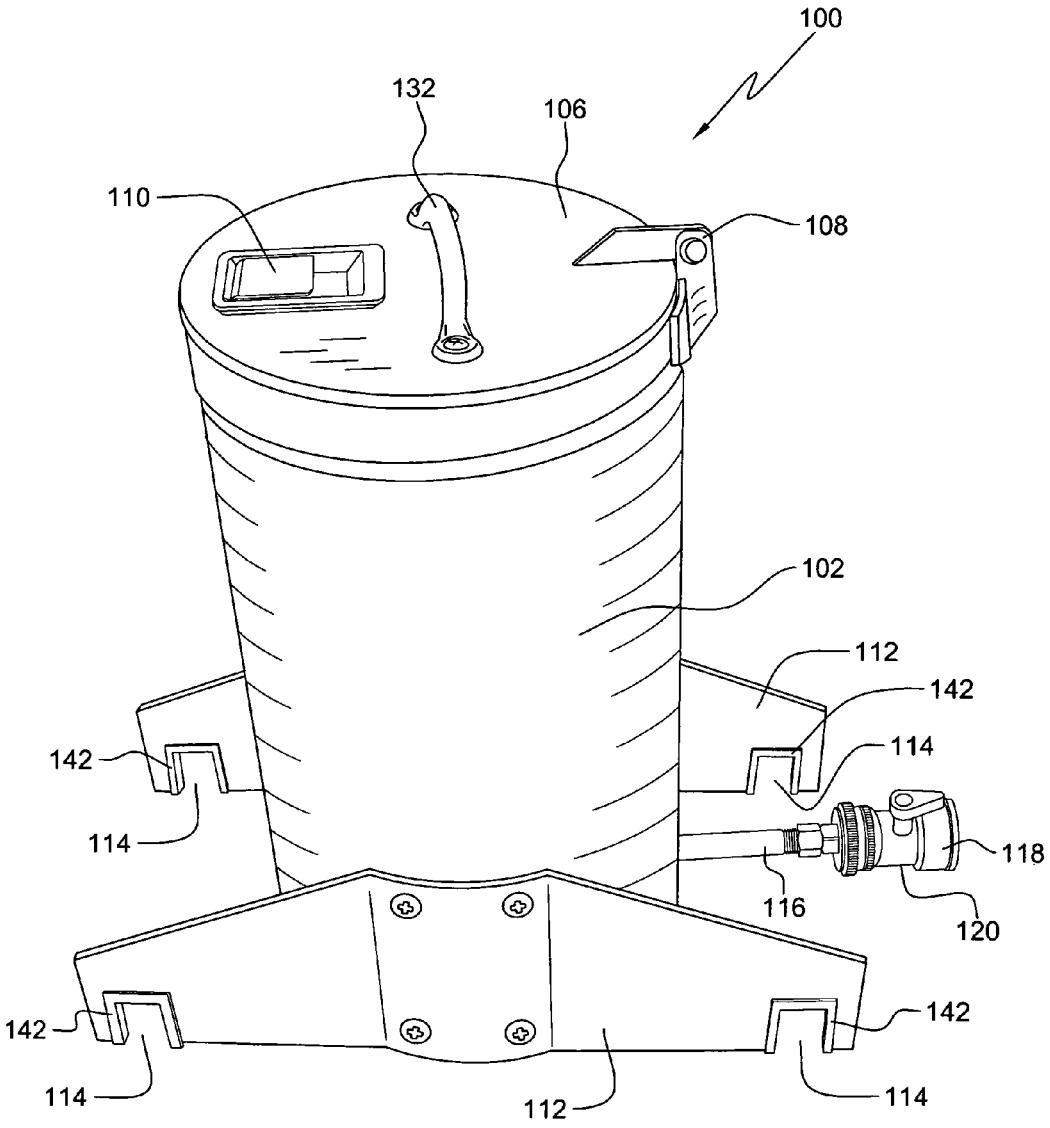
FIG. 1 is a side, perspective, schematic view of the paint roller cleaning and drying apparatus in accordance with the invention in a lid closed configuration.
Figure 2:
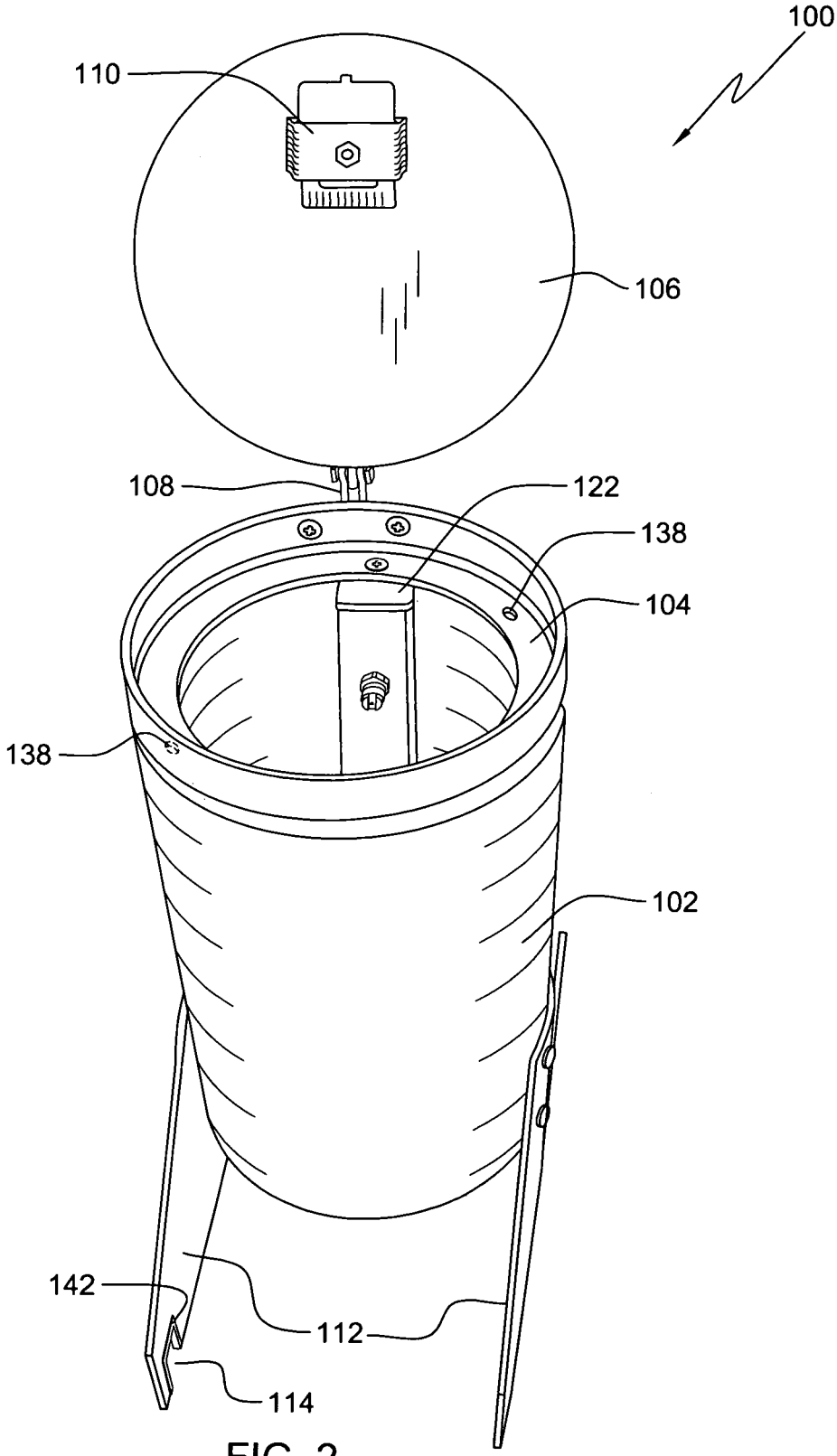
FIG. 2 is a side, perspective, schematic view of the paint roller cleaning and drying apparatus of FIG. 1 in a lid open configurations.
Figure 3:
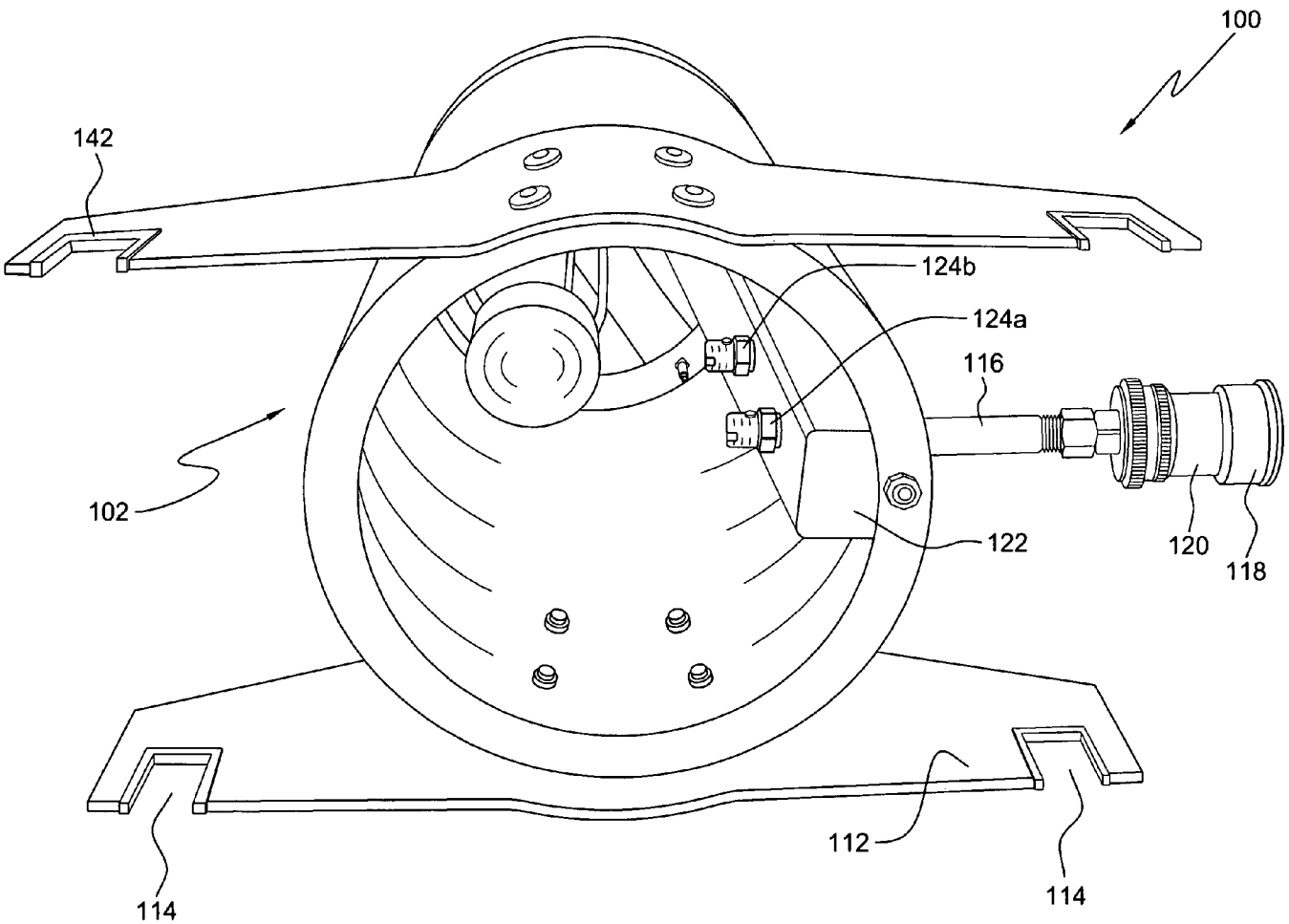
FIG. 3 is a bottom plan view of the paint roller cleaning and drying apparatus of FIGS. 1 and 2.

Referring to FIGS. 1, 2, and 3, there are shown side perspective, front perspective, and bottom plan, schematic views, respectively, of the paint roller cleaning and drying apparatus of the invention, generally at reference number 100. Paint roller cleaning and drying apparatus 100 has a hollow, generally cylindrical body 102, typically disposed in a vertical orientation. Body 102 has an open upper, proximal end with a flange 104 affixed adjacent thereto.

A top or cover 106 is hingedly attached to body 102 by hinge 108. Top cover 106 is sized and configured to fit into and be supported by flange 104 when in a closed configuration. A latch 110 on cover 106 retains cover 106 within flange 104.

A handle 132 disposed on top cover 106 allows a user of paint roller cleaning and drying apparatus 100 to readily raise cover 106 from a closed configuration as seen in FIG. 1 to an open configuration as seen in FIG. 2. In addition, handle 132 facilitates transportation of paint roller cleaning and drying apparatus 100.

Figure 5:
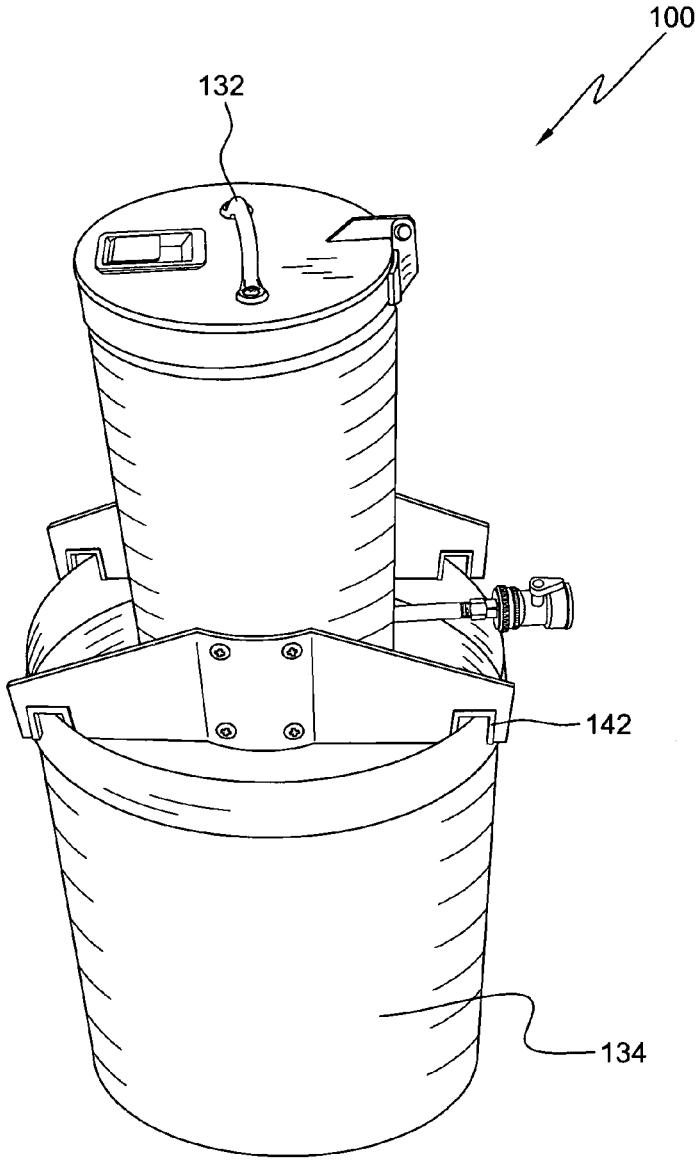
FIG. 5 is a side, perspective view of the paint roller cleaning and drying apparatus of FIG. 1 disposed atop a bucket to illustrate a typical operating environment for the apparatus.

Support legs 112 are attached to an outside surface of body 102 to support body 102 in an upright, perpendicular, spaced apart relationship to a horizontal environmental surface upon which paint roller cleaning and drying apparatus 100 may be placed. Legs 112 are positioned so that an open bottom portion of body 102 may be slightly elevated above a horizontal environmental surface upon which body 102 may be placed. Typically, legs 112 have one or more pairs of notches 114 formed in bottom edges thereof. The size and spacing of notches 114 in legs 112 may be chosen such that notches 114 receive the upper edge of a bucket or pail 134 (FIG. 5) and body 102 is supported thereupon. It will be recognized that a bucket or pail 134 forms no part of the present invention and is shown to illustrate one potential operating environment for paint roller cleaning and drying apparatus 100. Optionally, rubber inserts 142 may be placed in notches 114 to provide a sung fit between notches and the rim of a bucket or pail 134 (FIG. 5).

A fluid inlet tube 116 having a hose fitting 118 at its distal end passes through body 102 and terminates in an interior region of a hollow nozzle plenum 122 disposed inside body 102. Hose fitting may be selected to connect to an appropriate source of fluid. In alternate embodiments, fluid inlet tube may be connected directly to a fluid source and hose fitting 118 may be eliminated.

Nozzle plenum 122 is oriented substantially parallel to a major axis of body 102 (i.e., vertically). A plurality of nozzles 124*a* . . . 124*n* is disposed in nozzle plenum 122 in communication with an inner region thereof. Each nozzle 124*a* . . . 124*n* is oriented so as to emit a stream of fluid from nozzle plenum 122 into an inner region, not specifically identified, of body 102. The number, size, style, spray pattern, etc. of nozzles 124*a* . . . 124*n* may be varied to meet a particular operating circumstance or environment. The specific design details of nozzles 124*a* . . . 124*n* form no part of the present invention. It will be recognized that it is desirable that nozzles 124*a* . . . 124*n* be removably attached to nozzle plenum 122 to facilitate replacement thereof. Screw fittings well known to those of skill in the art are typically used to accomplish such removability. Nozzles 124*a* . . . 124*n* may readily be seen in FIG. 4*a*.

A shut-off valve 120 may optionally be placed along fluid inlet tube 114 and hose fitting 118.

Figure 4A:
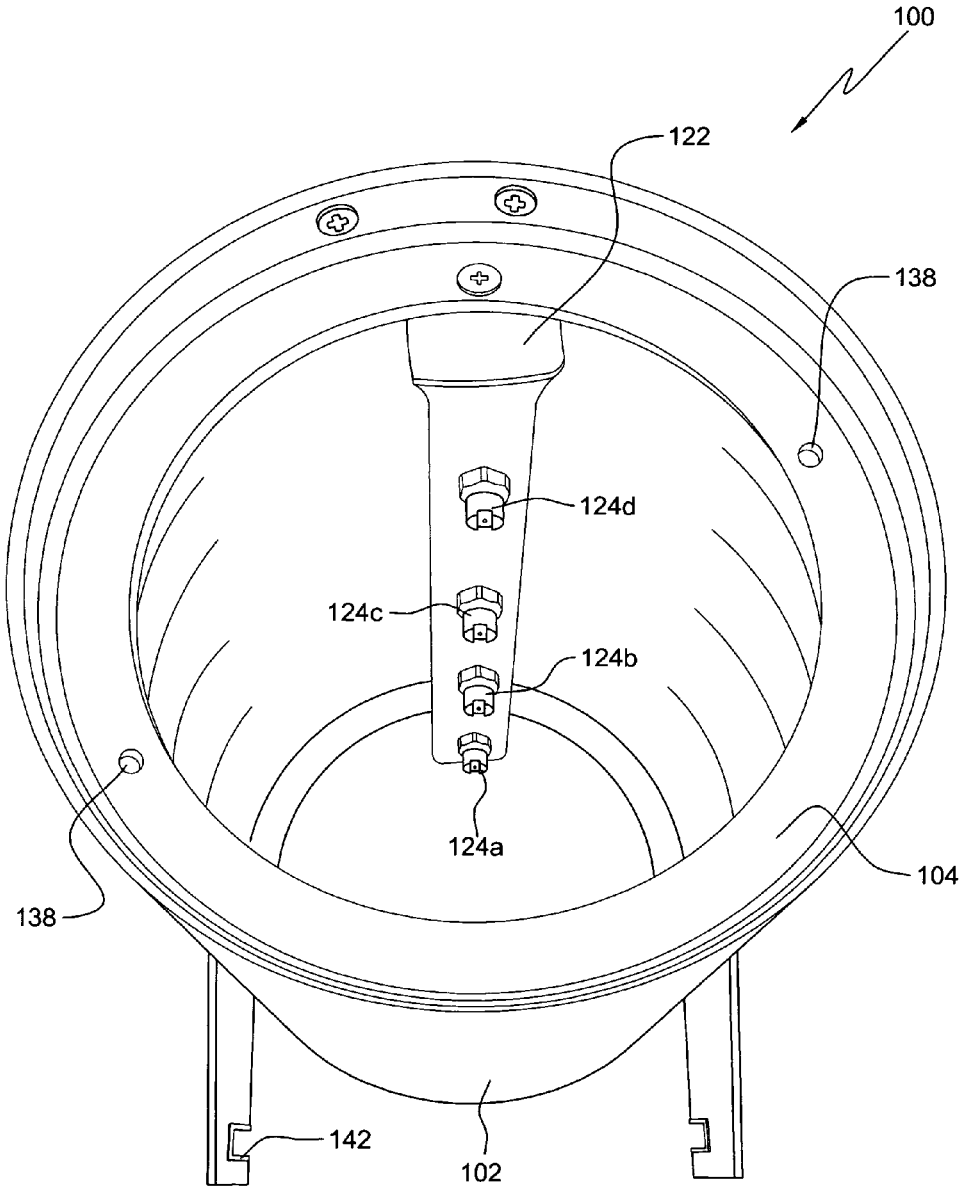
FIG. 4*a* is a top, perspective, schematic view of the paint roller cleaning and drying apparatus of FIG. 1 with the roller support assembly removed.
Figure 4B:
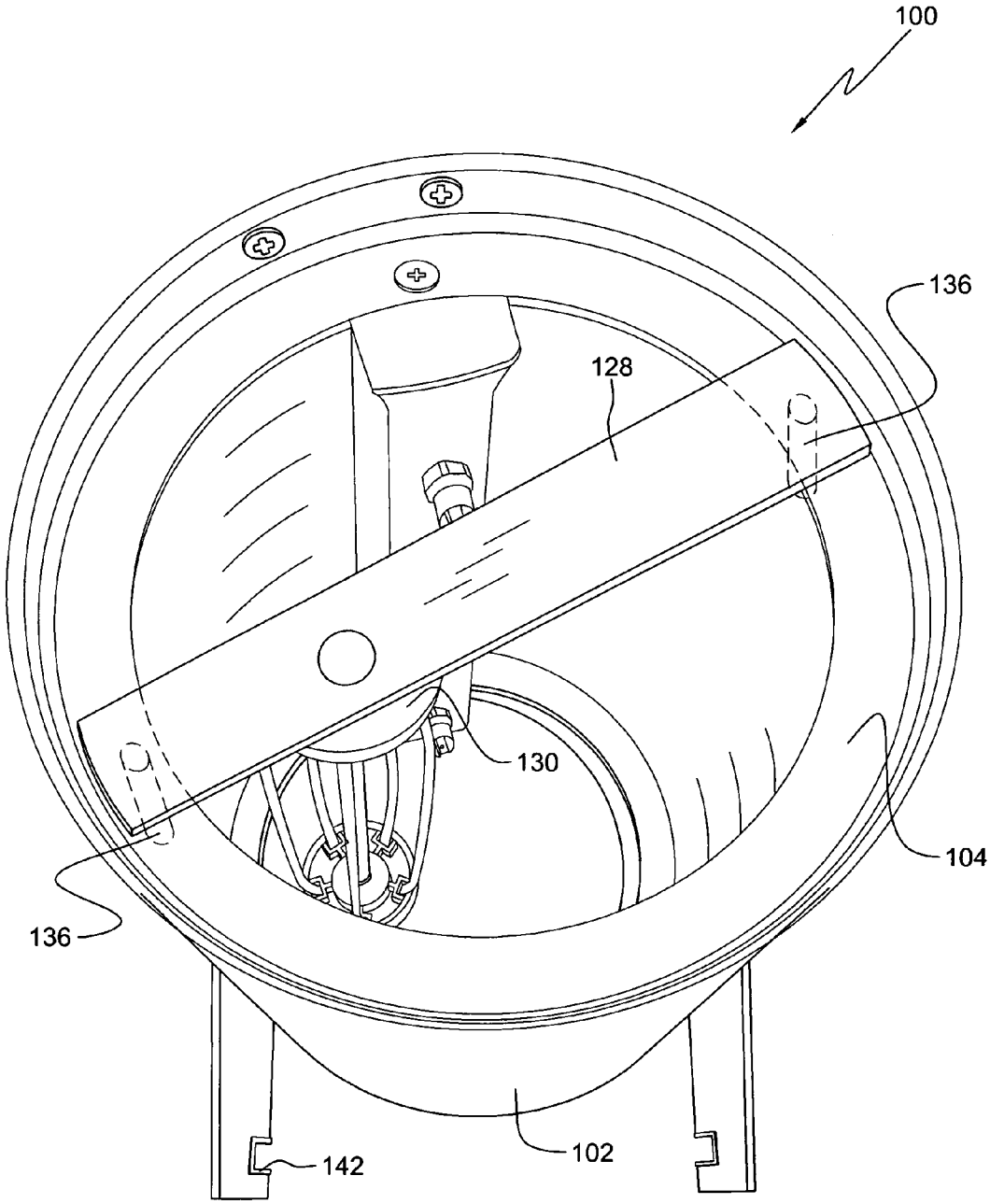
FIG. 4*b* is a top, perspective, schematic view of the paint roller cleaning and drying apparatus of FIG. 1 with the roller support assembly in place.

Referring now also to FIGS. 4*a* and 4*b*, there are shown top, perspective, schematic view of the paint roller cleaning and drying apparatus 100 with the roller support bar 128/roller core assembly 130 removed and with the roller support bar 128/roller core assembly in place, respectively.

As best seen in FIG. 4*b*, a roller support bar 128 sits across the top opening of body 102 supported by flange 104, substantially bisecting the top opening. Pins 136 disposed at each end of roller support bar 128 interact with holes 138 in top flange 104 secure roller support bar 128 and roller core assembly 130 in place within the internal region of body 102. It will be recognized that more than one pin, not shown, at each end of roller support bar 128 in conjunction with multiple holes in top flange 104 may be used to provide improve stability of roller support bar 128. Consequently, the invention is not considered limited to the single pin 136 at each end of roller support bar 128 chosen for purposes of disclosure. Rather, the invention covers the use of multiple pins 136 at each end of roller support bar 128 acting cooperatively with corresponding holes 134 in top flange 104.

A roller core assembly 130 adapted to receive a paint roller cover, not shown, to be cleaned depends from a lower surface of roller support bar 128. Roller core assembly 130 is free to rotate upon an axle, not specifically identified, depending from a lower surface of roller support bar 128. Roller core assembly 130 is typically disposed so that jets of fluid, not shown, from nozzles 124*a* . . . 124*n* strike a roller cover disposed thereupon tangentially to the outer surface of the roller cover. It will be recognized that support bar 128 may support additional roller core supports 130, possibly of different diameters to allow cleaning of different diameter roller covers, not shown. It will be further recognized that if multiple roller core assemblies are included, nozzles 124*a* . . . 124*n* may need to be aimed in different orientations to properly direct fluid to all roller covers being cleaned.

Figure 6:
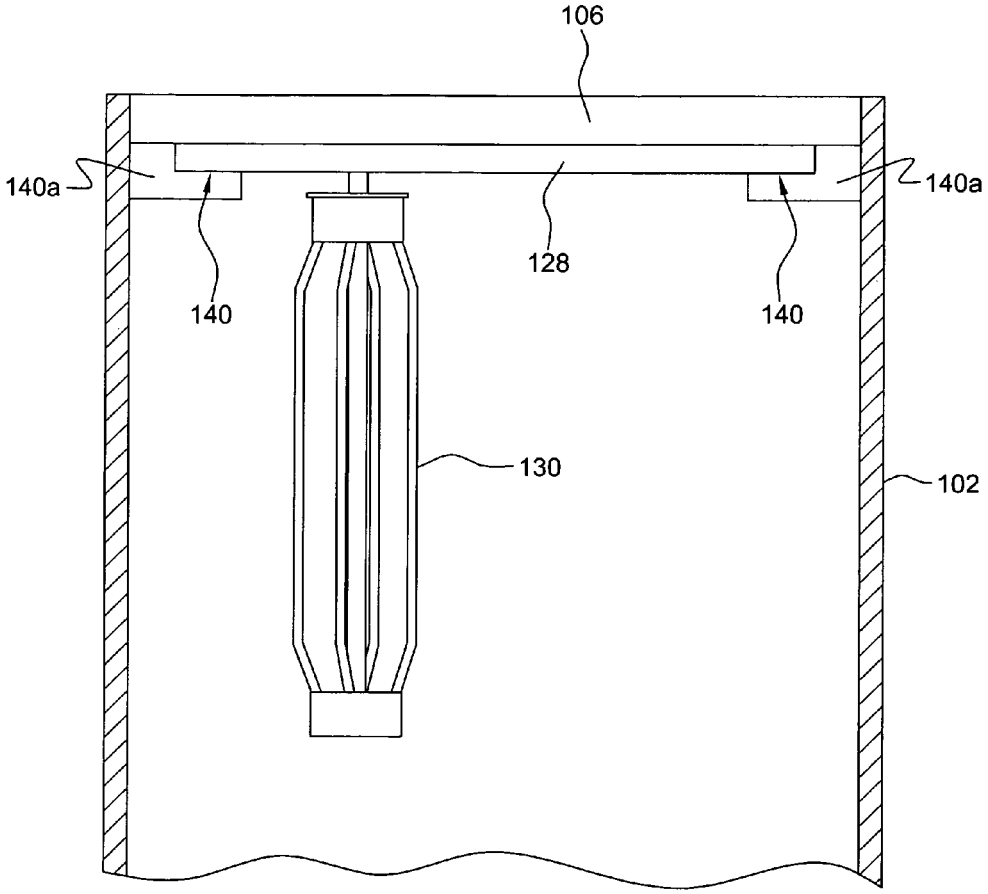
FIG. 6 is a partial, side, elevational, cross-sectional, schematic view of an alternate embodiment of paint roller cleaning and drying assembly in accordance with the invention.

Referring now to FIG. 6, there is shown a partial, side, elevational, cross-sectional, schematic view of an alternate embodiment of paint roller cleaning and drying assembly 100. In the embodiment of FIG. 6, top flange 140*a* is relatively thick and carries notches 140 sized and adapted to receive roller support bar 128 and roller core assembly 130. The configuration of the embodiment of FIG. 6 is believed to provide improved stability of roller support bar 128 during operation of paint roller cleaning and drying assembly 100 compared to the embodiment of FIGS. 4*a* and 4*b*.

In operation, paint roller cleaning and drying assembly 100 is situated over a drain or on a bucket (secured thereto by slots 114. A paint roller cover to be cleaned is slid onto roller core assembly 130 and roller support bar 128 is suitably positioned across the top of body 102 supported by flange 104. Cover 102 is them moved to a closed position and secured by latch/handle 110.

A source of suitable cleaning fluid is connected to fluid inlet tube 116 via hose fitting 118. If present, valve 120 is opened to allow fluid to flow through fluid inlet tube 116 and into nozzle plenum 122. Fluid is ejected as a spray of a desired pattern controlled primarily by the design of nozzles 124*a* . . . 124*n* and the pressure of the fluid applied to hose fitting 118.

As fluid from nozzles 124*a* . . . 124*n* impinges upon the roller cover being cleaned, paint or other material filling the nap of the roller cover is dislodged and or dissolved by the fluid spray. As the fluid spray impinges tangentially upon the surface of the roller cover, the roller cover on roller core assembly 130 spins, thereby exposing the entire perimeter of the roller cover to the fluid spray from nozzles 124*a* . . . 124*n*.

Waste fluid from the roller cover is free to drain out of body 102 through bottom opening 126 and, subsequently, flows down a drain or is collected in a pail or bucket, not shown, upon which roller cleaning and drying apparatus is positioned.

Once the roller cover is cleaned, the flow of fluid to nozzles 124*a* . . . 124*n* may be discontinued. As fluid flow is discontinued, the roller cover mounted on roller core 130 continues to spin. Centrifugal force tends to throw off any remaining water from the roller cover being cleaned. By the time spinning ceases, the roller cover is substantially dry and ready for immediate reuse.

In alternate embodiments, not shown, the roller cover may then be dried by applying a source of compressed air to hose fitting 118 which, in turn, flows from nozzles 124*a* . . . 124*n* to spin and dry the roller cover installed on roller core assembly 130.

It will be recognized that in alternate embodiments, two hose fittings, not shown and a valve that switches between the two hose connections may be used to alternate a flow of cleaning fluid and drying air to nozzle plenum 122 and nozzles 124*a* . . . 124*n*.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A paint roller cover cleaning and drying apparatus, comprising:

a) an elongated hollow body portion having an open distal end and an open proximal end;

b) a flange affixed to a proximal end of said elongated hollow body portion at said open proximal end;

c) a nozzle plenum disposed on an inside surface of said hollow body portion and disposed substantially parallel to a major axis thereof, wherein said nozzle plenum comprises a cross sectional area that varies along a major axis;

d) at least two nozzles disposed along a major axis of said nozzle plenum and communicative with an interior region thereof, said nozzles being directed toward a central portion of an interior region of said body portion; and e) a roller cover support depending from a lower surface of a roller support bar adapted for placement across said flange with said roller cover support being disposed within said interior region of said body portion.

2. The paint roller cover cleaning and drying apparatus as recited in claim 1, further comprising:

f) a pin disposed at each end of said roller support bar; and g) at least two holes disposed in said flange sized and adapted to receive said pins.

3. The paint roller cover cleaning and drying apparatus as recited in claim 1, further comprising:

f) a fluid inlet tube passing from a region outside said body portion through a wall thereof and communicative with an interior region of said nozzle plenum.

4. The paint roller cover cleaning and drying apparatus as recited in claim 3, wherein said fluid inlet tube comprises a distal end disposed in said region outside said body portion, and a hose fitting disposed at said distal end.

5. The paint roller cover cleaning and drying apparatus as recited in claim 4, wherein said fluid inlet tube further comprises a valve disposed between said distal end and said wall of said body portion.

6. The paint roller cover cleaning and drying apparatus as recited in claim 1, further comprising:

f) a cover adapted to close said proximal end of said body portion, said cover being hingedly attached to said body portion and movable between an open configuration and a closed configuration, said cover being supported on said flange when in said closed configuration.

7. The paint roller cover cleaning and drying apparatus as recited in claim 6, wherein said cover comprises at least one of the items selected from the group: a handle, and a latch mechanism.

8. The paint roller cover cleaning and drying apparatus as recited in claim 6, wherein said cover comprises a combination handle and latch mechanism.

9. The paint roller cover cleaning and drying apparatus as recited in claim 1, wherein said body portion comprises a circular cross-sectional shape and wherein both said open proximal end and said open distal end are substantially circular.

10. The paint roller cover cleaning and drying apparatus as recited in claim 1, further comprising:

f) legs attached to said body potion proximate said open distal end thereof, said legs being disposed to support said body portion in an upright position with a major axis thereof oriented in a substantially vertical orientation.

11. The paint roller cover cleaning and drying apparatus as recited in claim 10, wherein said legs comprise slots disposed on a bottom surface thereof and adapted to engage an upper lip or rim of a bucket or pail and thereby secure said paint roller cover cleaning and drying apparatus over said bucket or pail.

12. The paint roller cover cleaning and drying apparatus as recited in claim 11, wherein said slots comprise at least two pairs of slots disposed on said bottom surface of said legs, each of said at least two pairs of slots being configured to engage a lip or rim of a different diameter bucket or pail.

13. The paint roller cover cleaning and drying apparatus as recited in claim 1, wherein said at least two nozzles disposed along a major axis of said nozzle plenum are removably attached thereto.

14. The paint roller cover cleaning and drying apparatus as recited in claim 13, wherein said at least two removably attached nozzles comprise threaded portions for threadable engagement with compatible threads disposed in said nozzle plenum.

15. The paint roller cover cleaning and drying apparatus as recited in claim 1, wherein said roller cover support comprises at least two roller cover supports depending from said roller cover support bar.

16. The paint roller cover cleaning and drying apparatus as recited in claim 15 wherein at least one of said at least two roller cover supports is adapted to receive a roller cover of a different diameter than at least one other of said at least two roller cover supports.

17. The paint roller cover cleaning and drying apparatus as recited in claim 15, wherein at least two nozzles disposed along a major axis of said nozzle plenum comprises nozzles aimed at each of said at least two roller cover supports.

18. The paint roller cover cleaning and drying apparatus as recited in claim 1, wherein said top flange comprises a pair of diametrically opposed notches being sized and configured to receive a respective end of said roller support bar therein.

* * * * *